US008757263B2

(12) United States Patent
Barykin

(10) Patent No.: US 8,757,263 B2
(45) Date of Patent: Jun. 24, 2014

(54) DOWNHOLE CYCLIC PRESSURE PULSE GENERATOR AND METHOD FOR INCREASING THE PERMEABILITY OF PAY RESERVOIR

(75) Inventor: Alexey Evgenievich Barykin, Moskovskaya oblast (RU)

(73) Assignee: Schlumberger Technology Corporation, Sugar Land, TX (US)

( * ) Notice: Subject to any disclaimer, the term of this patent is extended or adjusted under 35 U.S.C. 154(b) by 442 days.

(21) Appl. No.: 12/307,192

(22) PCT Filed: May 30, 2007

(86) PCT No.: PCT/RU2007/000283

§ 371 (c)(1), (2), (4) Date: Jun. 9, 2009

(87) PCT Pub. No.: WO2007/139450

PCT Pub. Date: Dec. 6, 2007

(65) Prior Publication Data

US 2009/0301721 A1 Dec. 10, 2009

(30) Foreign Application Priority Data

May 31, 2006 (RU) ..... 2006118851

(51) Int. Cl.
*E21B 29/02* (2006.01)
*F42B 3/00* (2006.01)
*E21B 43/117* (2006.01)

(52) U.S. Cl.
USPC ..... 166/299; 166/262; 166/63; 102/318; 102/301; 102/311; 102/313; 102/314; 102/332; 89/1.15; 89/1.151

(58) Field of Classification Search
USPC ..... 166/299, 262, 63; 102/301, 311, 314, 102/331, 332
See application file for complete search history.

(56) References Cited

U.S. PATENT DOCUMENTS 3,090,436 A 5/1963 Briggs, Jr.
3,174,545 A 3/1965 Mohaupt (Continued)

FOREIGN PATENT DOCUMENTS

RU 2 018 508 C1 8/1994
RU 2018508 C1 8/1994

(Continued)

OTHER PUBLICATIONS

Swift, R. P., and Kusbov, A.S., Multiple Fracturing of Boreholes by Using Tailored-Pulse Loading, SPE Journal, 1982 N 12, pp. 923-932.
Sulimov, A.A., Ermolaev, B.S., Quasisteady Convective Burning of Low-Porosity Energetic Materials, Chem. Phys. Reports, 1997, V. 16(9), pp. 1573, Moscow, Russia.

(Continued)

*Primary Examiner* — Angela M DiTrani
*Assistant Examiner* — Silvana Runyan
(74) *Attorney, Agent, or Firm* — Jeremy D. Tillman; Rachel E. Greene; Tim Curington

(57) ABSTRACT

This invention relates to the oil and gas industry and to exploration and production of water resources, in particularly, for stimulation of fluid flow to the well, e.g., for higher oil production, productivity index, and recovery factor. The disclosed device and method can be used for higher permeability of the pay zone due to creation of a network of microcracks in the bottomhole formation zone and facilitates to increase the flow of oil, or other fluids, from the reservoir to the well. Generation of cyclic pressure pulses with varied amplitude and time parameters and proper localization of pulses in space through mechanism of convective combustion provides a "soft" impact upon the wellbore without risk of damage or formation consolidation; the said impact is achieved by using a device which is a downhole cyclic pressure generator operating by a consecutive combustion of layers of compositions having different combustion rates. The compositions are made on the basis of loose-packed solid fuel, solid oxidizer, and functional additive of a liquid hydrocarbon.

20 Claims, 1 Drawing Sheet

(56) References Cited

U.S. PATENT DOCUMENTS

| | | | | | |
|---|---|---|---|---|---|
| 3,422,760 | A | | 1/1969 | Mohaupt | |
| 3,702,635 | A | * | 11/1972 | Farr | 166/299 |
| 3,721,297 | A | * | 3/1973 | Challacombe | 166/299 |
| 4,530,396 | A | | 7/1985 | Mohaupt | |
| 4,683,943 | A | | 8/1987 | Hill et al. | |
| 4,976,318 | A | * | 12/1990 | Mohaupt | 166/311 |
| 5,005,641 | A | | 4/1991 | Mohaupt | |
| 5,046,567 | A | * | 9/1991 | Aitken et al. | 175/4.6 |
| 5,295,545 | A | | 3/1994 | Passamaneck | |
| 5,690,171 | A | | 11/1997 | Winch et al. | |
| 6,557,650 | B2 | * | 5/2003 | Fayard et al. | 175/4.59 |
| 7,451,819 | B2 | * | 11/2008 | Chang et al. | 166/299 |
| 2007/0256826 | A1 | * | 11/2007 | Ceccarelli et al. | 166/63 |

FOREIGN PATENT DOCUMENTS

| | | | |
|---|---|---|---|
| RU | 1 711 516 | A1 | 8/1995 |
| RU | 1711516 | A1 | 8/1995 |
| RU | 2 047 744 | C1 | 11/1995 |
| RU | 2047744 | C1 | 11/1995 |
| RU | 2 103 493 | C1 | 1/1998 |
| RU | 2 111 448 | C1 | 5/1998 |
| RU | 2 175 059 | C1 | 10/2001 |
| RU | 2 190 585 | C1 | 10/2002 |
| RU | 2 204 706 | C1 | 5/2003 |
| RU | 2215725 | A | 1/2005 |
| RU | 2275500 | A | 3/2006 |
| SU | 912918 | A1 | 3/1982 |
| SU | 933959 | A1 | 6/1982 |
| SU | 1574799 | A1 | 6/1990 |

OTHER PUBLICATIONS

Sulimov, A.A., Ermolaev, B.S., Korotkov, A.I., Okunev, V.A., Posvyanskii, V.S. and Foteenkov, V.A, Laws of Propagation of Convective Combustion Waves in a Closed Volume, Fizika Goreniya i Vzryva, 1987, vol. 23, N. 6, pp. 9-16, Moscow, Russia.

Belikov, E.P., Khrapovskii, V.E., Ermolaev, B. S., and Sulimov, A.A., Fizika Goreniya i Vzryva Development Features of an Explosion in a Model Power Mixture of Ammonium Percholorate-Polystyrene, 1990, V. 26, N. 4, pp. 464-468, Moscow, Russia.

Ermolaev, B.S., Sulimov, A.A., Belyaev, A.A., Roman'Kov, A.V., and Posvyanski, V.S., Modeling of Convective Combusion for Inihibited Energetic Materials, Khimicheskaya Fizika, 2001, vol. 20, No. 1, p. 84.

Belyaev et al., "Transition from combustion of condensed systems in explosion," Nauka, Moscow, 1973.

Sulimov et al., "Laws of Propagation of Convective Combustion Waves in a Closed Volume," Combustion, Explosion and Shock Waves, 1987, pp. 669-675, vol. 23, No. 6, 1988 Plenum Publishing Corporation.

Belyaev et al., "Propagation of convective combustion in porous explosives," Transition from combustion of condensed systems in explosion Part I, Chapter V, Paragraph 23 Nauka, Moscow, 1973. English translation provided. 5 pages total.

Chuprakov, "Porous rock failure with downhole pressure pulsing," SMR report, Mar. 16, 2004-Nov. 16, 2004, Part I, 61 pages total.

Chuprakov, "Porous rock failure due to downhole pressure pulsations. Part II.," SMR report, Mar. 16, 2004-Nov. 16, 2004, Part II, 107 pages total.

* cited by examiner

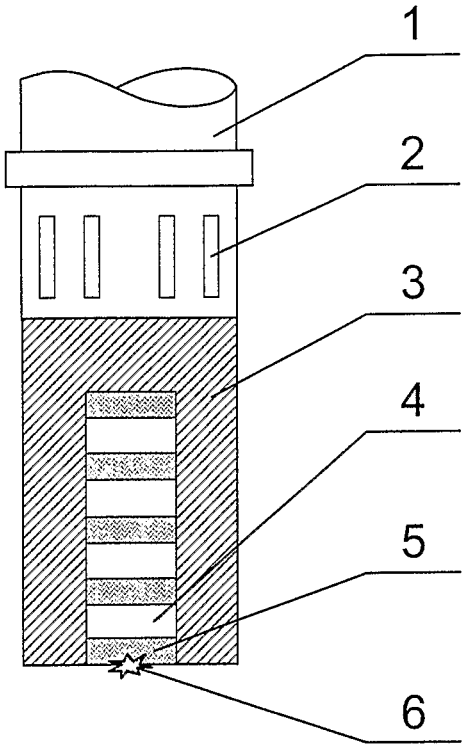
1
2
3
4
5
6

DOWNHOLE CYCLIC PRESSURE PULSE GENERATOR AND METHOD FOR INCREASING THE PERMEABILITY OF PAY RESERVOIR

FIELD OF THE INVENTION

This invention relates to the oil and gas industry and to exploration and production of water resources, in particularly, for stimulation of fluid flow to the well, e.g., for higher oil production, productivity index, and recovery factor. The disclosed device and method can be used for increasing permeability of the pay reservoir due to creation of a network of microcracks in the near wellbore zone and facilitates the increase in the flow of oil, or other fluids, from the reservoir to the well.

BACKGROUND OF THE INVENTION

A cyclic pressure pulse generator for downhole application based on charges consisting of propellant layers burning sequentially with alternating rates was developed. Layers consist of loose-packed particulate mixtures of solid fuel, solid oxidizer and hydrocarbon functional additive.

There are several traditional approaches for formation treatment: acidizing and hydraulic fracturing; they are based on pumping of high volumes of treatment fluid to the well.

The disclosed device and method relate to the impulsive method of formation stimulation. The device induces creation of numerous cracks/fissures in the subterranean formation. This method can be considered as independent treatment or used in combination with traditional treatments, e.g., as a prerequisite stage to hydraulic fracturing.

Existing vibro-cracking models demonstrate that the impact of pressure pulses with a higher frequency and amplitude (better at the level of tens of MPa) produces massive spalling in the near-wellbore zone, and if the well has a fracture already, this creates new cracks spreading outward from existing fracture. It appears to be quite difficult to attain pressure pulses of sufficient magnitude and required frequency by conventional mechanical devices in practical application of this model.

On the other hand, as reported in [Pioneering new concepts in wireline conveyed stimulation and surveillance. Hi-Tech Natural Resources, Inc, 1991; Swift R. P., Kusubov A. S., Multiple Fracturing of Boreholes By Using Tailored-pulse Loading, SPE Journal, 1982, N 12, pp. 923-932] even without cyclic pulsing, multiple radially oriented fractures may be formed provided the fast rise of fracture-forming stress, in excess of $10^4$ MPa/s.

Hence, development of pulse treatment for pay reservoir necessitates search for a design of the pressure pulse source that combines opportunities of a cycle of pressure pulses and flexibility of amplitude and time parameters, while keeping a higher power of total impact.

Burning of fuel oxidizer compounds, e.g. particulate mixtures based on 'metal fuel-solid oxidizer-liquid additive' type compositions might be considered a way of producing pressure pulses of required characteristics. This approach provides several positive outcomes:

(a) possibility to attain pulsing regime by controlling burning velocity, e.g. varying mixture composition, size of particles, and charge porosity (density):

(b) high energetics due to presence of metal particles hence providing charge compactness;

(c) possibility to adjust pressure pulse profile and place of impact by providing conditions for partly water reacting charge, namely providing rich mixture, that would react downstream the injection trajectory;

(d) little or no shattering or compaction of the formation.

Energetic materials in general are capable of a dual reacting regime:

- supersonic regime: a combustion wave preceded by a strong shock wave brings about a detonation wave, propagating at a speed on the order of several km/s and limited by the total thermochemical energy content of the reacting material;
- subsonic regime: a combustion wave brings about a deflagration wave, propagating at a velocity on the order of cm/s and limited by heat and mass transfer processes.

The disclosed method describes the use of imperfect mode of charge combustion which is close to the subsonic mode, but still able to produce strong shock waves. The physical and chemical properties of the mixed charges dictate the convective mode of combustion.

Convective burning is a special sort of burning in porous energetic materials, sustained and propagated due to convective heat transfer from hot burning products. Burning products penetrate into pore spaces of the charge and provide conditions for heating and ignition of energetic material at pore surfaces [A. F. Belyaev and V. K. Bobolev, Transition from Deflagration to Detonation in Condensed Phases (National Technical Information Service, Springfield, Va., 1973); Sulimov A. A., Ermolaev B. S. , Chem. Phys. Reports, 1997, V.16(9), pp. 1573-1601; Sulimov A. A., Ermolaev B. S., et al. , Combustion, Explosion and Shock Waves, 1987, Vol. 23, N.6, pp. 669-675; E. P. Belikov, V. E. Khrapovskii, B. S. Ermolaev and A. A. Sulimov, Combustion, Explosion and Shock Waves, 1990, V.26, N.4, pp. 464-468].

The characteristic feature of convective burning is a wide range of combustion wave velocity: from several meters per second up to several hundred meters per second. The wave velocity depends on the following parameters:

- properties of mixture components (energy density, temperature for particle ignition, particulate size, etc.);
- properties of charges (geometry, composition, porosity, heterogeneity and layers in the charge assembly);
- initial conditions (temperature and pressure).

The possibility to control convective combustion and obtain reproducible parameters of pulses for a desired range of velocity and pressure had been checked in [E. P. Belikov, V. E. Khrapovskii, B. S. Ermolaev and A. A. Sulimov, Combustion, Explosion and Shock Waves, 1990, V.26, N.4, pp. 464-468; Sulimov A. A., Ermolaev B. S., Belyaev A. A, et al., Khimicheskaya Physika, 2001, V.20, N.1, p.84]. This demonstrated that the convective combustion is quite attractive as a tool for pressure pulse generation.

We should note that up to now the researches have been performed experiments mainly for gun powder systems without metal fuel additives (e.g., aluminum) or only for the single-pulse mode.

For the disclosed design of the cyclic pressure pulse generator, the preferred composition of combustion mixtures is a solid fuel and solid oxidizer, e.g., a mix of aluminum powder, ammonium nitrate or perchlorate with additive of kerosene or nitromethane. However, other combustion mixtures can be used: the metal powder can be substituted by coal powder, poly(methyl methacrylate) (PMMA) powder.

Experiments [Sulimov A. A., Ermolaev B. S., Belyaev A. A, et al., Khimicheskaya Physika, 2001, V.20, N.1, p.84] confirmed the practical possibility to achieve convective combustion of mixtures comprising ammonium perchlorate and aluminum powder. Experiments were carried out in a constant-volume bomb setup for tracking the initiation and development of convective combustion in this type of mixture.

The prior art in oil production industry teaches that the compositions of metallic fuel with the perchlorate substance as oxidizer are well known and used in this industry.

The invention RU 2215725 describes the explosive composition comprising a perchlorate-type oxidizer, fuel and disruptive explosive, wherein the fuel can be organic non-explosive fuel or metallic fuel.

The invention RU 2190585 teaches about an explosive composition for wells; the composition is a mixture of oxidizer, hexogene, and fuel, wherein ammonium perchlorate is the oxidizer and fuel is aluminum or graphite powder.

However, these technical solutions produce only a single explosion and do not suite for "soft" impact on the wellbore shattering or compaction of the formation. There is no sufficient information about these devices to consider the opportunity to arrange the pulse-type combustion in the wellbore.

There exist several designs of solid-fuel gas generators for spalling of the reservoir. Several patents disclose gas generators based on granulated gun powder and solid propellant: the charges are loaded into a shell. These generators produce only a single fast pressure pulse suitable for creation a multitude of small cracks or one big fracture in the formation, depending on the pressure growth rate (RU2275500, RU2103493, SU912918, RU2175059, SU1574799, U.S. Pat. Nos. 5,295,545, 3,174,545, 3,422,760, 3,090,436, 4,530,396, 4,683,943, 5,005,641). However, the mentioned patents did not disclose the device and the basic composition of the mixture suitable for cyclic pulse mode of propellant combustion.

Patents U.S. Pat. No. 3,422,760 and RU 2204706 disclose the devices operating in pulsed mode due to successive combustion of several separate charges. The patent U.S. Pat. No. 4,530,396 describes the device with two charges having different combustion rates. Patents RU2018508, RU2047744, RU933959, RU2175059 describe different generators without shell: the solid-fuel cylindrical charges are lowered into the well on a cable or slickline and then activated downhole.

Several of mentioned patents describe the situation of pulsing behavior for pressure in the treatment zone after ignition of single charges. This behavior arises due to inertia of wellbore fluid and natural feature of gun powder charges: the combustion rate increases with pressure and decreases as it declines. But none of known designs consider generation of cyclic pressure pulses due to alternating of burning rate for layers of different porosity, where one could produce not a series of consecutive explosions, but rather a process of convective combustion of layers occurring with preselected rates.

The objective of this invention is developing a device and method for formation treatment through generating cyclic pressure pulses with variable amplitude and time characteristics: this series of pulses is localized in space and method ensures convective combustion suitable for "soft" impact upon the wellbore without well damaging and reservoir rock compression.

SUMMARY

This objective is achieved by designing a cyclic generator of pressure pulses for downhole application, wherein the device comprises of composition layers with different combustion rates. The compositions are loose-packed mixtures on the base of a solid fuel, solid oxidizer, and liquid hydrocarbon as a functional additive.

BRIEF DESCRIPTION OF THE DRAWINGS

FIG. 1 shows a diagram of a cyclic generator of pressure pluses.

DETAILED DESCRIPTION

The diagram of a cyclic generator of pressure pulses and its placement for practical usage is shown in FIG. 1, where 1 is the bottom end of production string, 2 are the slots for pumping, 3 is the injector case, 4 is the layer of composition with a low combustion rate, 5 is the layer of composition with a fast combustion rate, and 6 is the place of charge initiation.

The device operates in a following way. The production string 1 with slots 2 for pumping is lowered to the well. The cylindrical injector 3 is attached to the low end of the production string (it is made closed from the string side and open from another end). The charge is placed inside the injector: it comprises the interlaid layers of slow-combustion 4 and fast-combustion 5 compositions. After the charge is ignited at the open end 6, the alternating layers 4 and 5 burn out consequently, producing minimums and maximums in the pressure evolution at the generator outlet.

The combustion rate for every layer can be controlled through variation in porosity—by adding a liquid hydrocarbon that fills the charge pores or by variation of fuel/oxidizer particle size, or through layer geometry (thickness and diameter).

The required parameters of pulse length and pulse ratio are chosen through pressure tests. For example, a set of several layers with different combustion rates is ignited in a pressure chamber and a plotting "pressure vs. time" is recorded. If the pressure evolution creates deviations from the expected pulse shape/duration/ratio, the ratio of layer masses, component concentration or fast/slow layer porosity can be varied. If the testing curve "pressure vs. time" is required for a higher number of propellant layers, the test is repeated in the pressure chamber with the initial pressure equal the final pressure of previous experiments after burning the last layer.

The basic composition for the disclosed method is a mixture of aluminum powder and particulate of ammonium perchlorate/nitrate with the size of 90-120 microns with added nitromethane or kerosene (5-40%). The solid fuel/oxidizer ratio is close to stoichiometric one. Other types of mixtures can be considered also, e.g., with coal powder or poly(methyl methacrylate) powder as the fuel component.

The invention claimed is:

1. A downhole cyclic pressure pulse generator comprising:

a case comprising an open end exposed to a surrounding well environment;

a charge assembly comprising at least three successive interbedded layers comprising a middle layer and two adjacent layers; and a blasting cap disposed at the open end of the case, wherein the combustion rate of the middle layer is higher than a combustion rate of at least one of the two adjacent layers, and the blasting cap is adapted to ignite one of the at least three successive interbedded layers to generate pressure pulses having at least two different amplitude-time profiles to stimulate a well reservoir.

2. The downhole cyclic pressure pulse generator of claim 1, wherein at least one of the three successive layers comprises a composition adapted to provide a convective burning regime.

3. The downhole cyclic pressure pulse generator of claim 1, wherein at least one of the three successive layers comprises a composition adapted to provide a convective burning regime that transitions into a low-speed detonation.

4. The downhole cyclic pressure pulse generator of claim 1, wherein at least one of the three successive layers comprises a mixture of a loose-packed solid fuel and a solid oxidizer.

5. The downhole cyclic pressure pulse generator of claim 4, wherein the solid fuel is selected from the group consisting of aluminum powder, coal powder, and poly (methyl methacrylate) (PMMA) powder, and the solid oxidizer is selected from a group consisting of ammonium nitrate and ammonium perchlorate.

6. The downhole cyclic pressure pulse generator of claim 4, wherein the combustion rate of the at least one layer is a function of at least a porosity and a fuel particle size.

7. The downhole cyclic pressure pulse generator of claim 1, wherein at least one of the three successive layers comprises a mixture of a loose-packed solid oxidizer, a solid fuel and a functional additive of a liquid hydrocarbon.

8. The downhole cyclic pressure pulse generator of claim 7, wherein the solid fuel is selected from the group consisting of aluminum powder, coal powder, and poly(methyl methacrylate) (PMMA) powder, the solid oxidizer is selected from a group consisting of ammonium nitrate and ammonium perchlorate, and the functional additive is selected from the group consisting of kerosene and nitromethane.

9. The downhole cyclic pressure pulse generator of claim 1, wherein the case is adapted to be disposed at a downhole end of a tubular string adapted to communicate a fluid downhole into the string such that the fluid exits at least one port of the string above the generator such that the open end is exposed to a well environment.

10. The downhole cyclic pressure pulse generator of claim 1, wherein the combustion rate of the middle layer is higher than combustion rates of both of the two adjacent layers.

11. A method comprising:

running an assembly into a well on a tubing string, the assembly being disposed at a lower end of the tubing string; and using the assembly to produce pressure pulses to increase a permeability of a reservoir, wherein:

using the assembly comprises igniting charges of the assembly using a blasting cap at an open end of the assembly exposed to a well environment exterior to the assembly, wherein the charges comprise at least three successive layers, comprising a middle layer and two adjacent layers, and the combustion rate of the middle layer is higher than a combustion rate of at least one of the two adjacent layers.

12. The downhole cyclic pressure pulse generator of claim 11, wherein the combustion rate of the least one layer of the at least three successive layers is at least a function of a fuel particle size.

13. A downhole cyclic pressure pulse generator comprising:

a case comprising an open end exposed to a surrounding well environment;

a charge assembly comprising at least three successive interbedded layers comprising a middle layer and two adjacent layers; and a blasting cap disposed at the open end of the case, wherein the combustion rate of the middle layer is lower than a combustion rate of at least one of the two adjacent layers, and the blasting cap is adapted to ignite one of the at least three successive interbedded layers to generate pressure pulses having at least two different amplitude-time profiles to stimulate a well reservoir.

14. The downhole cyclic pressure pulse generator of claim 13, wherein at least one of the three successive layers comprises a composition adapted to provide a convective burning regime.

15. The downhole cyclic pressure pulse generator of claim 13, wherein at least one of the three successive layers comprises a mixture of a loose-packed solid fuel and a solid oxidizer.

16. The downhole cyclic pressure pulse generator of claim 15, wherein the solid fuel is selected from the group consisting of aluminum powder, coal powder, and poly (methyl methacrylate) (PMMA) powder, and the solid oxidizer is selected from the group consisting of ammonium nitrate and ammonium perchlorate.

17. The downhole cyclic pressure pulse generator of claim 15, wherein the combustion rate of at least one of the three successive layers is a function of a porosity, an amount of added liquid hydrocarbon, particle size of the fuel and a particle size of the oxidizer.

18. The downhole cyclic pressure pulse generator of claim 13, wherein at least one of the three successive layers comprises a mixture of a loose-packed solid oxidizer, a solid fuel, and a functional additive of a liquid hydrocarbon.

19. The downhole cyclic pressure pulse generator of claim 18, wherein the solid fuel is selected from the group consisting of aluminum powder, coal powder, and poly(methyl methacrylate) (PMMA) powder, the solid oxidizer is selected from the group consisting of ammonium nitrate and ammonium perchlorate, and the functional additive is selected from the group consisting of kerosene and nitromethane.

20. The downhole cyclic pressure pulse generator of claim 13, wherein at least one of the layers comprises a composition adapted to provide a convective burning regime that transitions into a low-speed detonation.

* * * * *